United States Patent [19]

Hoffman

[11] 4,260,100

[45] Apr. 7, 1981

[54] CONTAINER CLOSURE

[75] Inventor: Ronald W. Hoffman, Manitowoc, Wis.

[73] Assignee: Weyerhaeuser Company, Tacoma, Wash.

[21] Appl. No.: 100,758

[22] Filed: Dec. 6, 1979

[51] Int. Cl.[3] ..... B65D 5/10

[52] U.S. Cl. ..... 229/39 R; 229/41 C

[58] Field of Search ..... 229/16 R, 39 R, 41 C

[56] References Cited

U.S. PATENT DOCUMENTS

| | | | |
|---|---|---|---|
| 1,425,549 | 8/1922 | Scruby | 229/39 R UX |
| 2,044,103 | 6/1936 | Rossi | 229/41 C UX |
| 2,565,188 | 8/1951 | Welshenbach | 229/16 R |
| 2,569,335 | 9/1951 | Phillips | 229/39 R |
| 2,828,904 | 4/1958 | Mires et al. | 229/41 C X |
| 3,014,637 | 12/1961 | Wilson | 229/39 R |
| 3,111,878 | 11/1963 | Welles et al. | 229/41 C X |
| 3,145,904 | 8/1964 | Bromley | 229/39 R |
| 3,526,352 | 9/1970 | Swett | 229/39 R |
| 3,661,319 | 5/1972 | Koehler | 229/41 C X |

*Primary Examiner*—Davis T. Moorhead

[57] ABSTRACT

A closure construction for a hexagonal or octagonal container utilizing hinged closure panels having integral tuck-in flaps.

4 Claims, 5 Drawing Figures

CONTAINER CLOSURE

BACKGROUND OF THE INVENTION

1. Field of the Invention

A closure construction for a container.

2. Prior Art

Welshenbach, U.S. Pat. No. 2,565,188 and Swett, U.S. Pat. No. 3,526,352 disclose typical closure constructions for octagonal containers.

Bromley, U.S. Pat. No. 3,145,904 discloses a typical closure locking construction.

SUMMARY OF THE INVENTION

A closure for a hexagonal or octagonal container is disclosed. In either construction, two opposed closure panels are hinged to the container body. Each of these closure panels is contoured to the outline of the side wall to which it is attached and the two side walls adjacent this side wall. Two integral tuck-in flaps are hinged to a closure panel and fit within the adjacent side walls. The two closure panels have a snap lock. In the octagonal container, an additional pair of opposed inner rectangular closure flaps are between the first closure panels.

DESCRIPTION OF THE PREFERRED EMBODIMENT

The closure construction is illustrated in conjunction with a telescoping container body.

Figure 1:
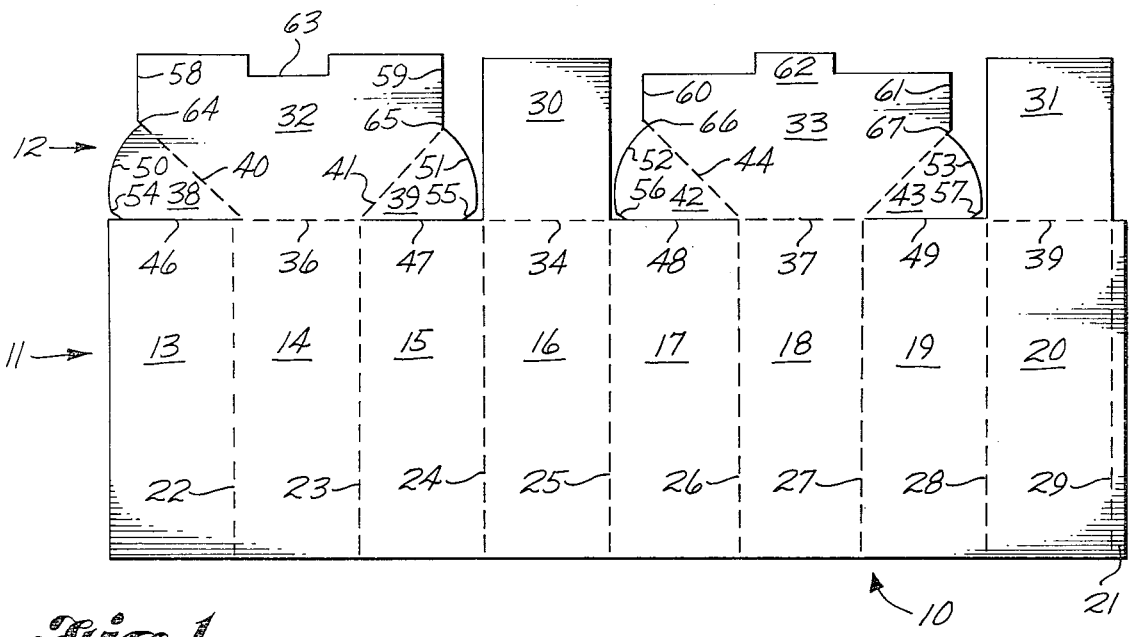
FIG. 1 is a top plan view of a blank for an octagonal container with the closure construction.
Figure 2:
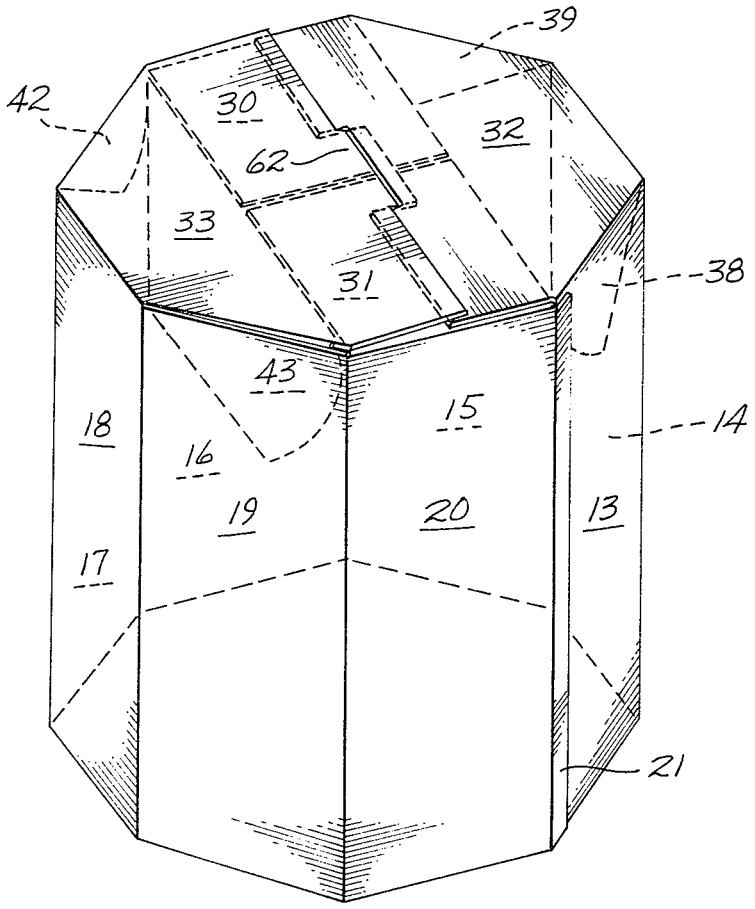
FIGS. 2–4 are isometric views of the container showing the closure of the container.
Figure 3:
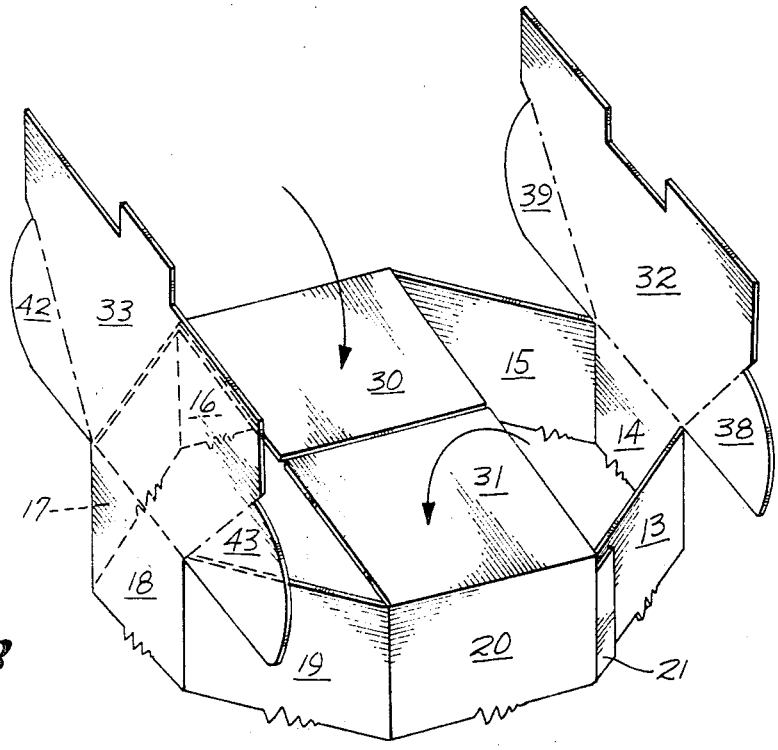
Figure 4:
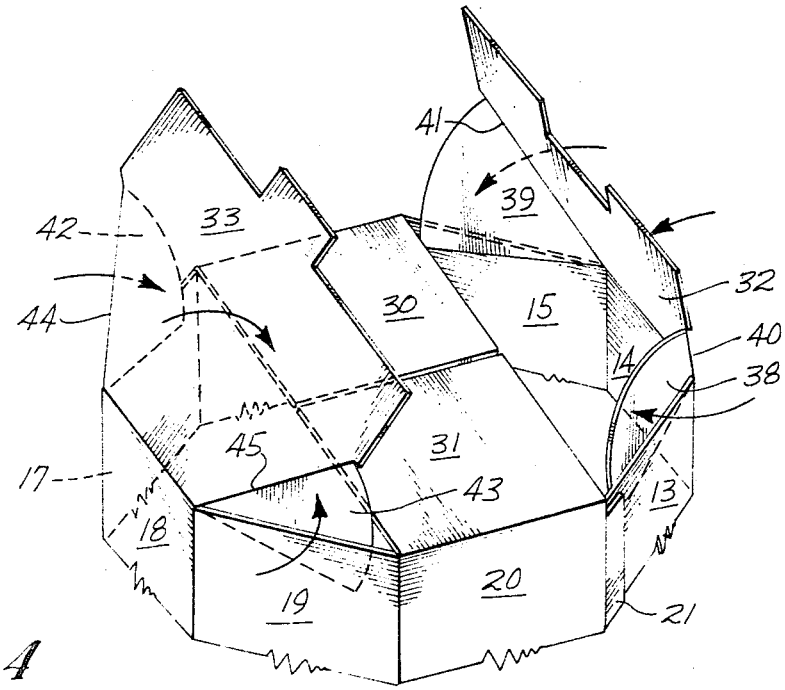

In FIG. 1, the blank 10 has a body portion 11 and a closure portion 12. Body portion 11 is divided into side walls 13–20 and a glue flap 21 by score lines 22–29.

The closure section 12 has two inner closure flaps 30 and 31 and two outer closure panels 32 and 33.

The inner closure flaps are hinged to opposed side walls, and are located between the outer closure panels. Inner closure flap 30 is attached to side wall 16 along score line 34 and inner closure flap 31 is connected to side wall 20 along score line 35. The inner closure flaps are rectanglar and will normally overlap in the center of the container.

The outer closure panels are also hinged to opposed side walls.

The outer closure panel 32 is attached to side wall 14 along score line 36 and the outer closure panel 33 is attached to side wall 18 along score line 37.

A pair of integral tuck-in flaps are hinged to each of the outer closure panels. Outer closure panel 32 has tuck-in flaps 38 and 39 connected along score lines 40 and 41 respectively while outer closure panel 33 has tuck-in flaps 42 and 43 connected along score lines 44 and 45, respectively. Each of the tuck-in flaps, somewhat triangular in shape, is defined on one side by the score line attaching it to the closure panel and on the opposite side by the slit separating it from its adjacent side wall. The score line attaching the tuck-in flap to the outer closure panel—score lines 40, 41, 44 and 45—are, in the octagonal container, at an angle of 45° to the upper edge of body 11. Each of the tuck-in flaps is separated from its adjacent wall by a slit, flap 38 being separated from side wall 13 by slit 46, flap 39 being separated from side wall 15 by slit 47, flap 42 being separated from side wall 17 by slit 48 and flap 43 being separated from side wall 19 by slit 49.

The outer edge of each of the tuck-in flaps—edges 50 on flap 38, 51 on flap 39, 52 on flap 42 and 53 on flap 43—is curved to allow the flap to be folded inside the side walls of the container. The distance from the apex, slightly offset from the upper edge of body 11, to the outer edge is slightly less than the width of the side wall. The lower corner of each of the tuck-in flaps, 54 on flap 38, 55 on flap 39, 56 on flap 42 and 57 on flap 43, has a smaller radius of curvature.

The periphery of the outer closure panels 32 and 33 defined by edges and score lines 58, 40 36, 41, and 59 on panel 32 and 60, 44, 37, 45 and 61 on panel 33 is identical to the outline of the container defined by the side walls. In the closed container the panel 33 will overlie the panel 32, and the tongue 62 on panel 33 will extend under rectangular notch 63 on panel 32 to lock the closure panels in place.

There is a notch between the tuck-in flaps and the closure panels This is shown by notches 64 and 65 between closure panel 32 and tuck-in flaps 38 and 39 and notches 66 and 67 between closure panel 33 and tuck-in flaps 42 and 43. These are the result of the tuck-in flaps being slightly shorter than the width of side walls and the adjacent edge of the closure panels being equal to the width of the side walls.

Figure 5:
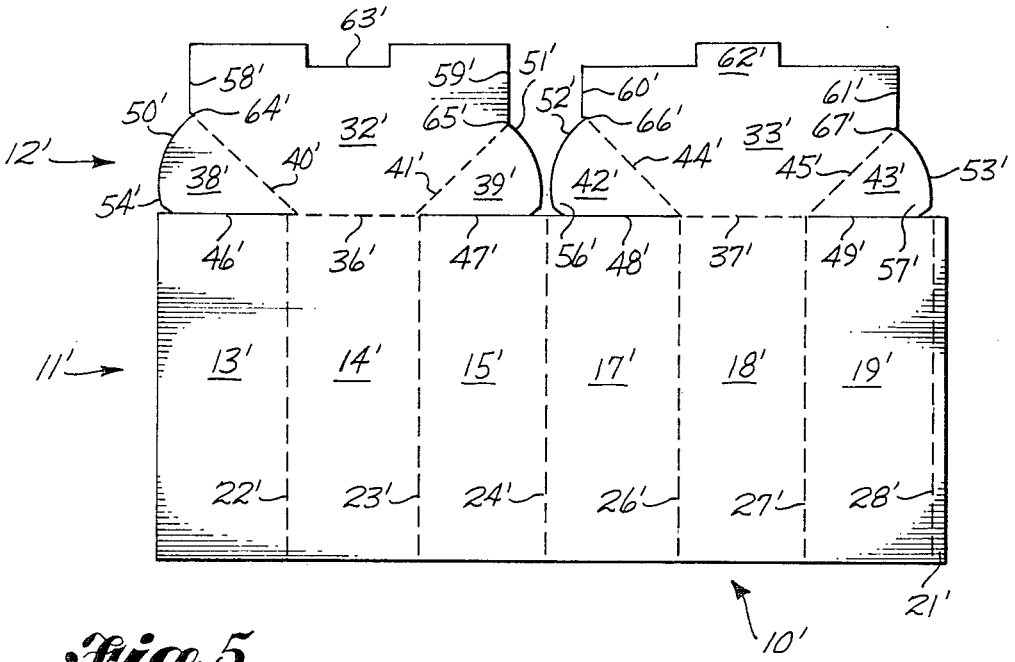
FIG. 5 is a top plan view of a blank for a hexagonal container with the closure construction.

The blank for a hexagonal container is shown in FIG. 5. The same reference numerals have been used to illustrate the similarities of the closures. The only difference between the octagonal and hexagonal containers and closures is the elimination of side walls 16 and 20 and their associated inner closure flaps 30 and 31, and changing the angle of the score lines for the tuck-in flaps to the upper edge of the body to 60° from 45°.

What is claimed is:

1. A closure for a container comprising a pair of closure panels hingedly connected to opposing first side walls, each of said closure panels having first side edges alignable with the upper edge of second side walls adjacent said first side wall, and second side edges alignable with third side walls adjacent said second side walls, tuck-in flaps hingedly connected to said closure panels by score lines along said first side edges, said tuck-in flaps having a radial outer edge, the radius of said tuck-in flap being less than that width of a side wall, the edge of said tuck-in flap opposite said score line being defined by a slit between said tuck-in flap and said second side walls, said closure panels overlapping in said closed container, one of said closure panels having a notch in its outer edge alignable with a tongue in the outer edge of the other of said closure panels.

2. The closure of claim 1 in which said container has an octagonal cross section further comprising inner rectangular closure flaps hingedly connected to said third side walls.

3. The closure of claims 1 or 2 in which said container has an octagonal cross section and said hinged connection of said tuck-in flaps is at an angle of 45° to the edge of said container body.

4. The closure of claim 1 in which said container has a hexagonal cross-section and the hinged connection of said tuck-in flaps is at an angle of 60° to the edge of said container body.

* * * * *